US005836675A

United States Patent [19]

Woodring

[11] Patent Number: 5,836,675

[45] Date of Patent: Nov. 17, 1998

[54] ILLUMINATED CLOSET ORGAINZER

[75] Inventor: Cooper C. Woodring, Topeka, Kans.

[73] Assignee: Barbara D. Arner, Oxnard, Calif.

[21] Appl. No.: 30,098

[22] Filed: Feb. 25, 1998

[51] Int. Cl.[6] ..... F21V 33/00

[52] U.S. Cl. ..... 362/234; 362/253; 211/1.56; 211/13

[58] Field of Search ..... 362/253, 234, 362/186, 311, 351, 361; 211/1.56, 13, 122; 198/678.1

[56] References Cited

U.S. PATENT DOCUMENTS

D. 298,591 11/1988 Arner et al. ..... D6/315

4,742,924 5/1988 Tarlow et al. ..... 211/60.1

5,474,187 12/1995 Taylor et al. ..... 211/1.56

5,645,173 7/1997 Taylor ..... 211/1.56

*Primary Examiner*—Thomas M. Sember

*Attorney, Agent, or Firm*—Oppenheimer Wolff & Donnelly LLP

[57] ABSTRACT

A closet organizer adapted to be secured to a closet rod or rack having a switch actuated rotatable belt. A plurality of said hooks are mounted on the belt for holding ties or belts. A translucent lighting panel extends about substantially the entire outer periphery of the organizer. Lights are disposed in the organizer for illuminating the panel and providing light below the switch when the belt is rotated.

10 Claims, 7 Drawing Sheets

ILLUMINATED CLOSET ORGAINZER

BACKGROUND OF THE INVENTION

FIELD OF THE INVENTION

The invention relates to closet organizers; and, more particularly, to a closet organizer illuminated about substantially its entire periphery.

INFORMATION DISCLOSURE

Closet organizers are well known. Generally, such organizers are elongated in configuration, mount to a preexisting rod or wire rack in a closet, and have a rotating track with a plurality of hooks from which tires or belts are hung. Some organizers have a light at front. There is a need for a closet organizer having a lighted area about its periphery. This assists one in picking out a tie or belt in addition to providing light in the closet.

SUMMARY OF THE INVENTION

It is an object of this invention to provide an illuminated closet organizer for ties and belts.

It is a further object of this invention to provide such an organizer which is illuminated substantially about its entire outer periphery. These and other objects are preferably accomplished by providing a closet organizer which is secured to a closet rod or rack having a switch actuated rotatable belt. A plurality of said hooks are mounted on the belt for holding ties or belts. A translucent lighting panel extends about substantially the entire outer periphery of the organizer. Lights are disposed in the organizer for illuminating the panel and providing light below the switch when the belt is rotated.

DESCRIPTION OF THE PREFERRED EMBODIMENT

Figure 1:
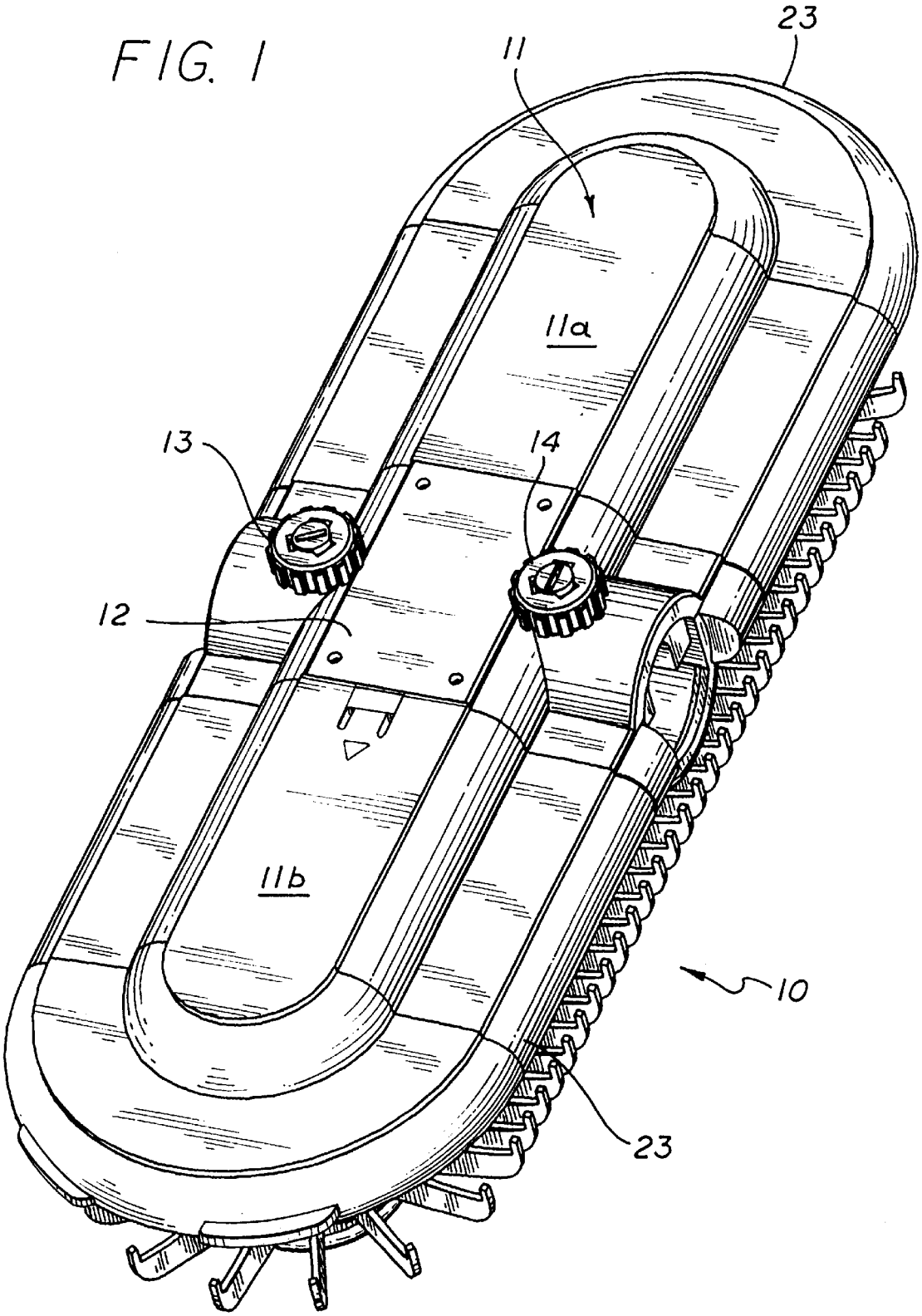
FIG. 1 is a top perspective view of a closet organizer in accordance with the teachings of the invention.
Figure 3:
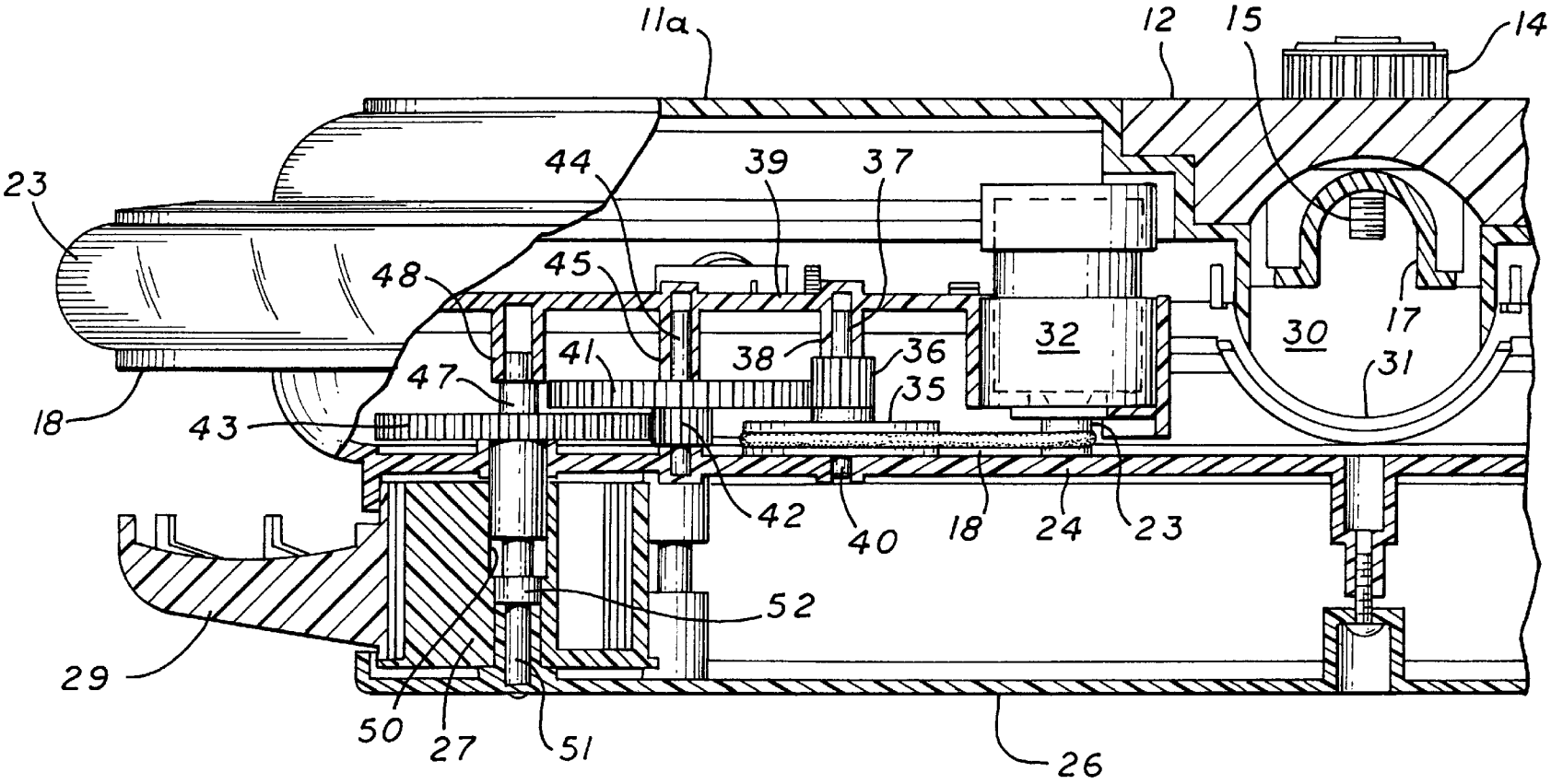
FIG. 3 is an elevated view, partly in section, of one half of the organizer of FIGS. 1 and 2, taken along lines 3—3 of FIG. 2.

Referring now to FIG. 1 of the drawing, a closet organizer 10 is shown having an elongated oblong top cabinet section 11 and an upper rod mounting plate 12. Cabinet section 11 may be of two separate pieces 11*a*, 11*b* with plate 12 at the middle thereof. Plate 11*b* may be a removable plate for access to the internal battery compartment (not shown in FIG. 1). Top cabinet section 11 is shown in cross-section in FIGS. 3 and 4 and thus extends from one end of organizer 10 to the other end thereof.

As seen in FIG. 1, a pair of spaced thumb screws 13, 14 are mounted on opposite sides of plate 12, each screw having a threaded shaft 15 (see FIGS. 3 and 4) extending downwardly through a threaded hole 16 on opposite sides of an inner arcuate partition wall section 17 below plate 12. A bottom cabinet section 18 closes off the bottom of top cabinet section 11 (FIGS. 3 and 4) and is secured thereto in any suitable manner.

Figure 5:
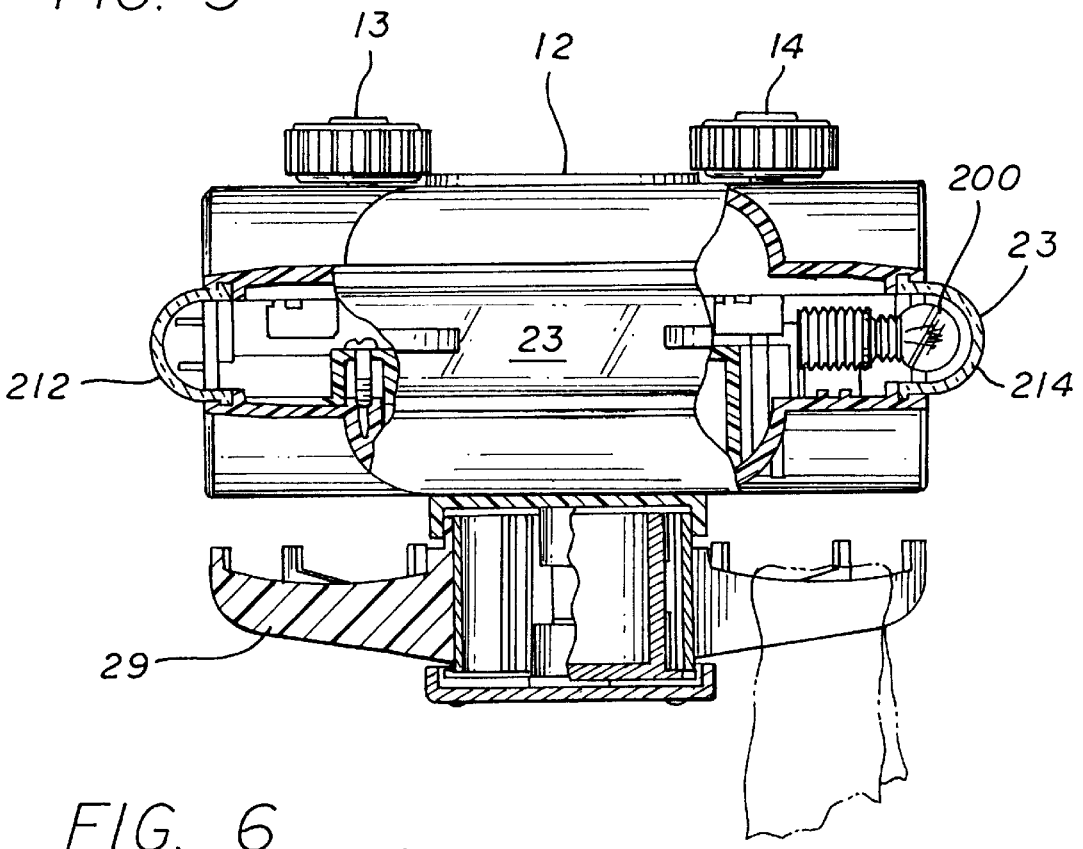
FIG. 5 is a view taken along lines 5—5 of FIG. 2.
Figure 6:
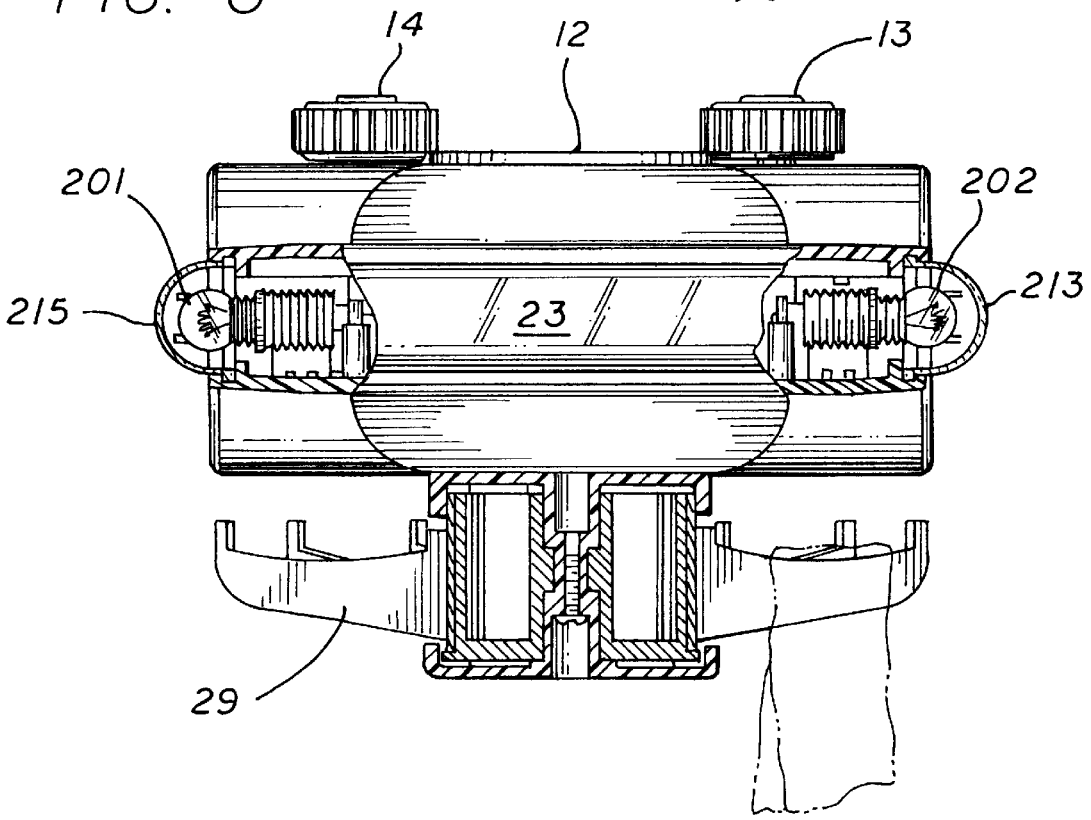
FIG. 6 is a view taken along lines 6—6 of FIG. 2.

A battery compartment 19 (FIG. 4) is provided in organizer 10 normally covered by a removable battery door or panel 11*b*. A plurality of lamps 21 are provided, such as lamp 21 (FIG. 4) electronically coupled to battery plate 21*a*, lamp 200 (FIG. 5), lamps 201, 202 (FIG. 6) disposed in compartment 22 normally covered on the exterior by translucent curved outer panel 23 sandwiched between upper and lower sections 11, 18. Any suitable number of lamps may be provided at spaced locations about the periphery of organizer 10, at spaced locations along each side and one at each end.

Figure 7:
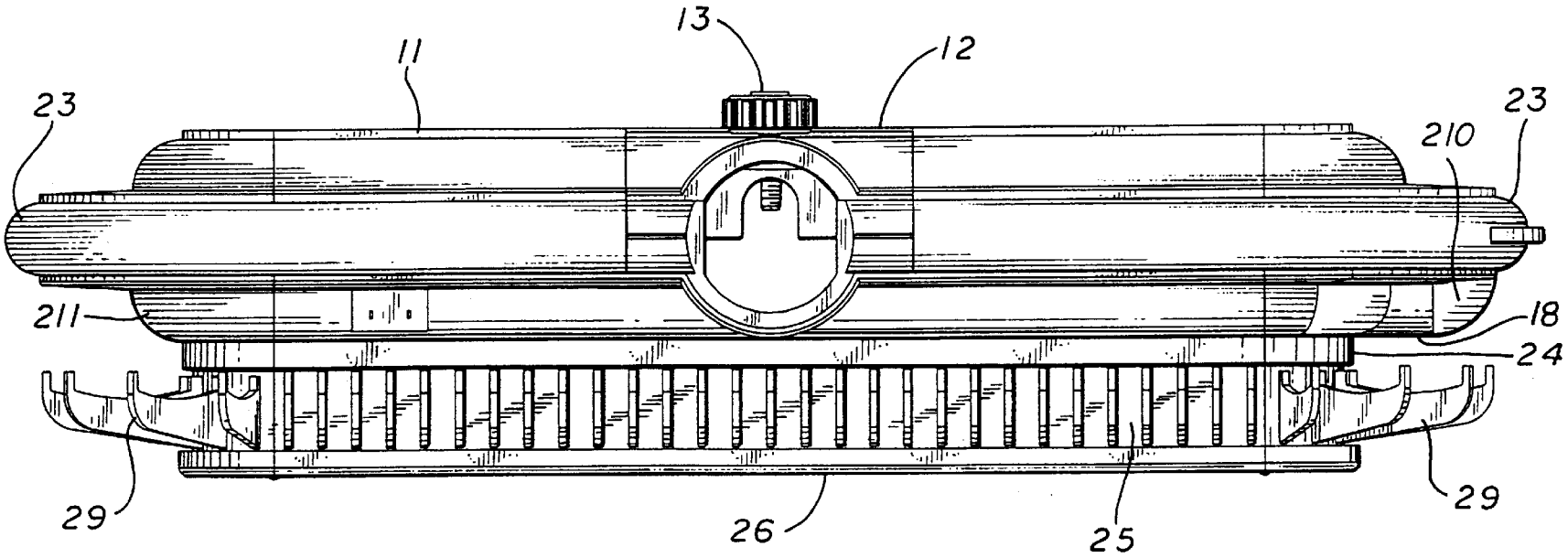
FIG. 7 is an elevational side view of the closet organizer of FIGS. 1 to 6.
Figure 8:
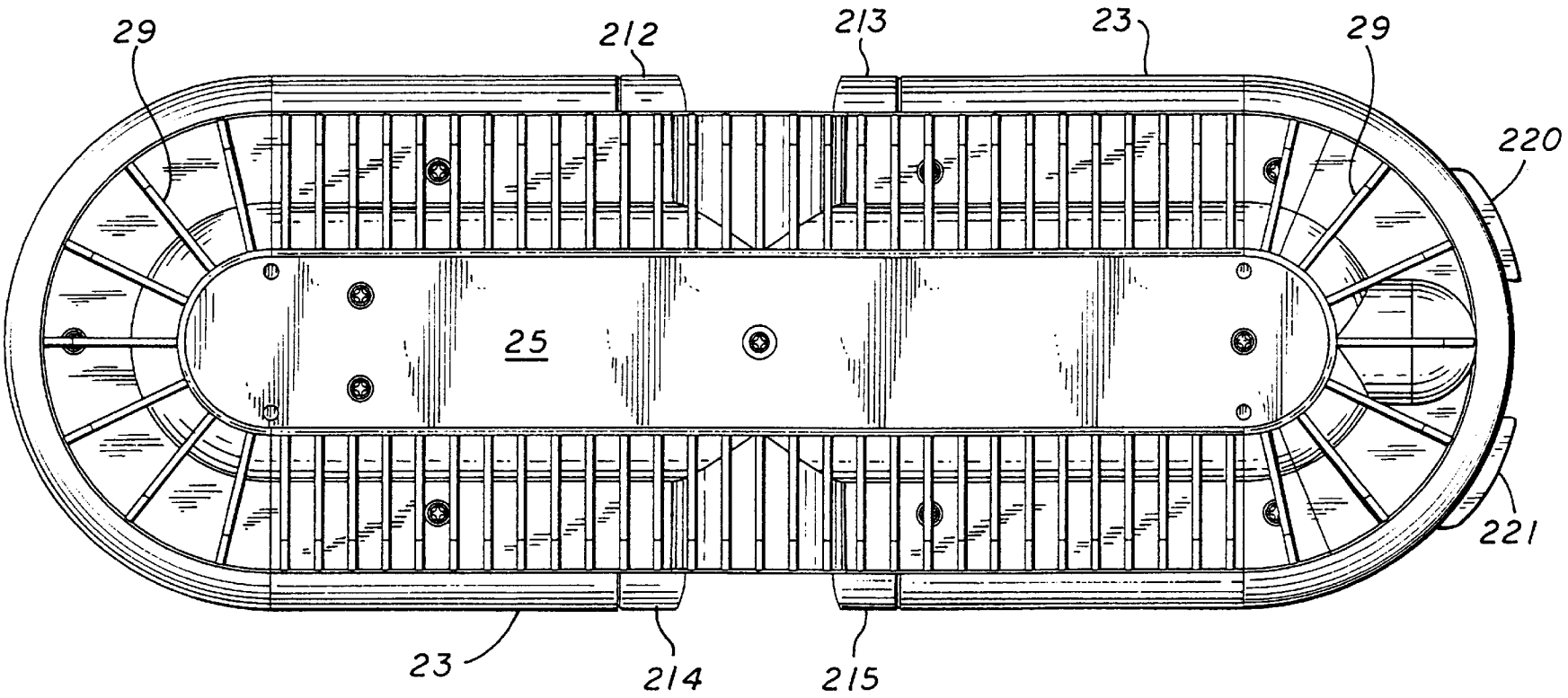
FIG. 8 is a bottom plan view of the organizer of FIGS. 1 to 7.

An integral housing portion 24 (FIG. 7) extends downwardly from bottom cabinet 18. A belt 25 is mounted in housing portion 24 (see FIGS. 3 and 4).

Belt 25 is wrapped around drums 27, 28. Drums 27, 28 are rotatably mounted such that the axes of rotation of each of drums 27, 28 are generally parallel to each other. A plurality of spaced hooks 29 are connected to belt 25 for rotation therewith to carry ties or belts thereon as is well known in the closet organizer art. Hooks 29 are thus integral with belt 25 and may be formed of plastic or any other suitable material.

Figure 2:
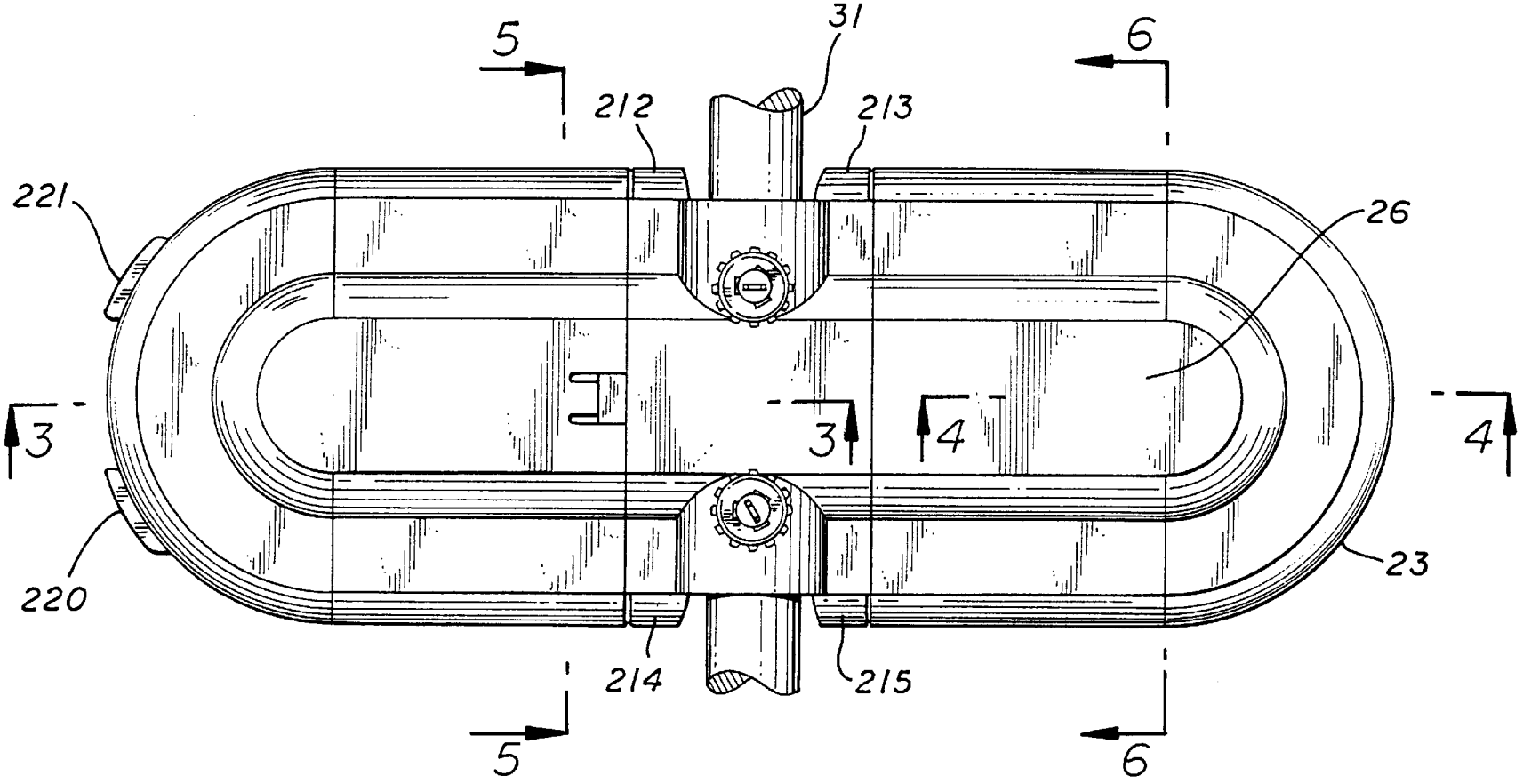
FIG. 2 is a top plan view of the organizer of FIG. 1.

The lamp cover 23 may be of a translucent material. The organizer 10 may be mounted in a closet or the like by means of a closet bar or rod 31 (FIG. 2) passing through the opening 30 (FIGS. 3 and 4) formed by the wall section 17 and the arcuate portion 31 of bottom cabinet section 18. Organizer 10 is secured thereto by tightening the shafts of screws 13, 14 against the closet rod.

Suitable gearing is provided for rotating belt 25 when motor 32 (FIG. 3) is actuated. When motor 32 is actuated, its shaft 33 rotates. Motor drive belt 34 extends about shaft 33 and about gear drive pulley 35 having integral gear 36 thereon. Gear 36 and pulley 35 is mounted to a shaft 37 journalled at one end for rotation in a boss 38 in partition wall 39 and at the other end in a hole 40 in housing portion 24. Gear 36 is in driving engagement with large gear 41 having a small gear 42 fixed thereto in driving engagement with gear 43. Gears 41 and 42 are mounted no shaft 44 journalled for rotation at one end in a boss 45 integral with partition wall 39 and at the other end in a hole 46 in housing portion 24. Gear 43 is mounted to shaft 47 journalled for rotation at one end in boss 48 integral with partition wall 39 and at the other end in a boss 49 in bottom plate 26. Drum 27 has a central hole 50 therethrough. A stud 51 extending through boss 49 to a central boss 52 providing a pivot for drum 27.

Thus, when motor 32 is activated, the gearing means rotates shaft 47 which coupled to boss 52 thus rotating drum 27. Drum 28 has a throughbore 53 with an inner ridge 54 mounted in an annular slot 55 in flange 56 so that it rotates about screw 57 coupling plate 26, integral with flange 56, to flange 58, integral with housing portion 24. A plurality of rollers 59 are mounted at spaced locations between housing portion 24 and bottom plate 26. Belt 25 thus extends about rollers 58 which supports belt 25 in its rotation.

In addition to translucent cover 23, arcuate end covers 210, 211 (FIG. 7) close off the bottom sides of organizer 10 below cover 23. Also, translucent covers 212 to 215 (se FIGS. 2, 5, and 6) close of the light compartments on opposite sides of the rod 31.

Figure 4:
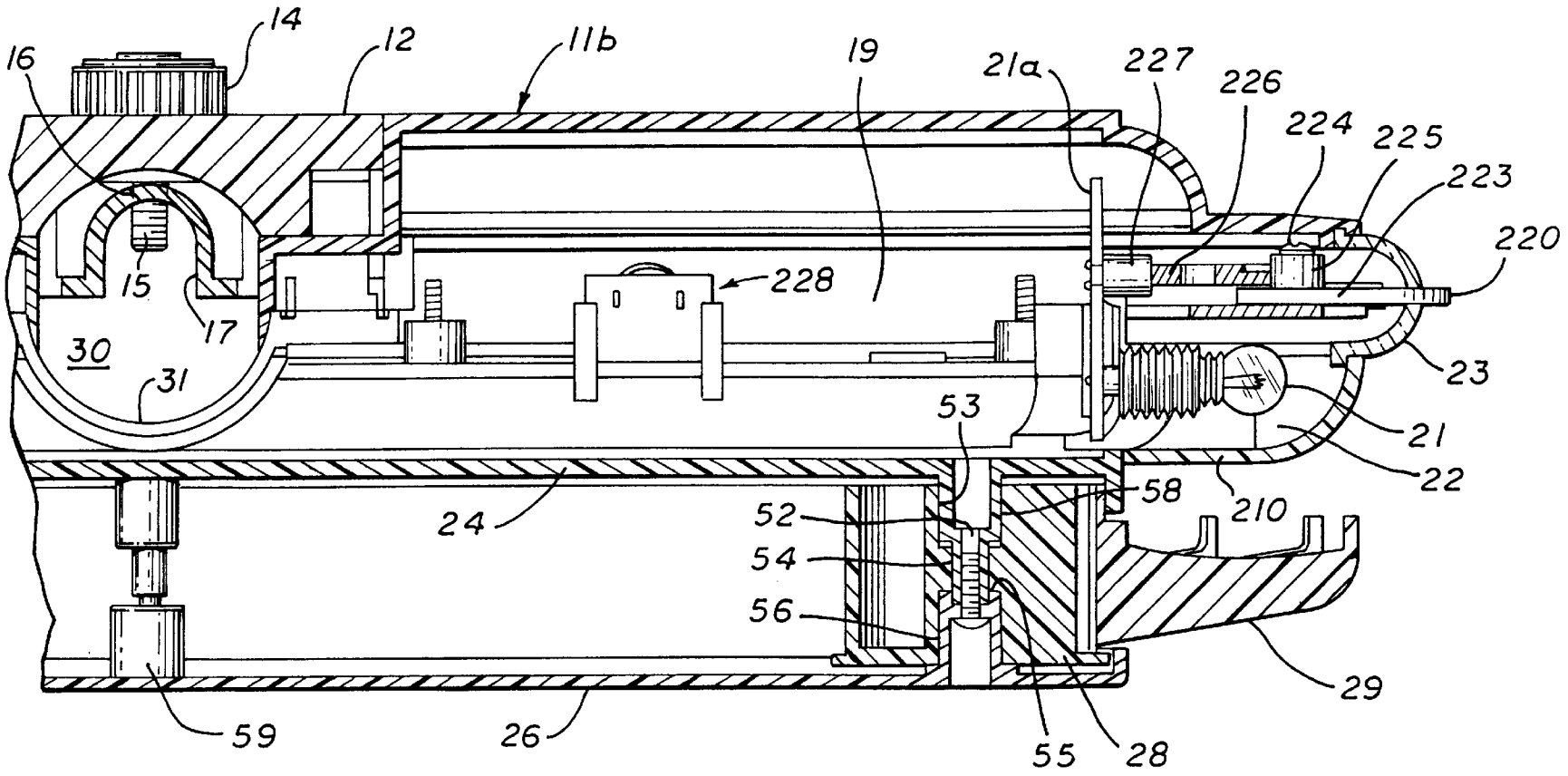
FIG. 4 is a view similar to FIG. 3 of the other half taken along lines 4—4 of FIG. 2.

A pair of switches 220, 221 (FIG. 2) are provided for turning the lights on and rotating belt 25. As seen in FIG. 4, switches 220, 221 are an integral part of switch plate 223 which pivots about screw 224 which extends into an integral boss 225 on plate 223. Plate 223 has an integral switch portion 226 which engages a switch 227 mounted on battery panel 21*a*. By selectively pivoting or rocking plate 223 about screw 224, switch 227 is activated in either selected direction to turn on the lights and rotate belt 25 via suitable electric connections as is well known in the art.

A timing mechanism 228 may be mounted internally of organizer 10 in electronic communication with switch 227 and the battery connections. Thus, belt 25 may rotate for a predetermined time while the lights light up the organizer 10.

The frosted cover 23 thus encircles the entire organizer to illuminate all the ties and belts disposed on hooks 29. The closet or the like in which the organizer 10 is installed is also lit up. Easy access is provided to the battery compartment 19 and easy installation is made to a preexisting closet rod or the like via thumb screws 13, 14. The curvature of hooks 29 prevent ties from slipping off. The easily accessed and easy touch on/off switch instantly activates rotation of belt 25 in either selected direction. There is 360° lighting provided about the entire outer periphery of organizer 10.

Although a bracket is disclosed for connecting organizer 10 to a preexisting closet rod, a hook (not shown) may be provided secured to thumb screws 13, 14. Thus, an organizer for a closet or the like is disclosed which will put one's tie or belt at one's fingertips in seconds. The entire organizer is illuminated along with the belts or ties, particularly by the light 21 disposed directly above the tie or belt and under the switches 220, 221.

I claim:

1. A closet organizer comprising:

an upper housing;

a lower housing secured to the upper housing;

a lighting compartment extending about the entire outer periphery of said organizer sandwiched between said upper and lower housing;

A rotatable belt having a plurality of spaced tie and belt receiving hooks mounted to said lower housing;

rotating means associated with said belt for selectively rotating the same;

a plurality of spaced lights mounted in said organizer, at least one light associated with said lighting compartment, said lighting compartment being closed off by a translucent panel; and electronic means coupled to said lights and said rotating means for selectively lighting said lights and rotating said belt.

2. The organizer of claim 1 including a switch coupled to said electronic means having a pair of spaced contacts extending out of said translucent panel, each of said contacts being integral with a pivotally mounted switching plate in selective contact with said electronic means, said electronic means including a motor adapted to rotate in one direction when one of said contacts is activated and rotate in another direction when the other of said contacts is rotated.

3. The organizer of claim 2 wherein at least one of said lights is mounted in a compartment below said switch.

4. The organizer of claim 3 wherein the compartment in which said light is mounted below said switch is closed off on the exterior by a translucent panel.

5. The organizer of claim 1 including a closet rod mounting plate coupled to said upper housing forming a throughbore for receiving a preexisting closet rod therethrough.

6. The organizer of claim 5 including a plurality of spaced thumbscrews extending from the exterior of said mounting plate into said throughbore adapted to secure said rod to said organizer hen said thumbscrews are tightened against said rod.

7. The organizer of claim 1 including timing means associated with said electronic means for selectively actuating said lights and said belt when said rotating means is actuated.

8. The organizer of claim 1 wherein said electronic means includes a battery compartment electronically coupled to said electronic means.

9. The organizer of claim 1 wherein a battery access panel is mounted in said upper housing for providing access to said battery compartment.

10. The organizer of claim 1 wherein said battery compartment includes a battery plate electronically coupled to said at least one light and said electronic means.

* * * * *